US010373584B2

(12) United States Patent
Orio et al.

(10) Patent No.: US 10,373,584 B2
(45) **Date of Patent: *Aug. 6, 2019**

(54) DEVICE AND METHOD FOR DISPLAY COLOR ADJUSTMENT

(71) Applicant: Synaptics Japan GK, Tokyo (JP)

(72) Inventors: Masao Orio, Tokyo (JP); Hirobumi Furihata, Tokyo (JP); Susumu Saito, Tokyo (JP); Takashi Nose, Tokyo (JP); Akio Sugiyama, Tokyo (JP)

(73) Assignee: SYNAPTICS JAPAN GK, Tokyo (JP)

( * ) Notice: Subject to any disclaimer, the term of this patent is extended or adjusted under 35 U.S.C. 154(b) by 134 days.

This patent is subject to a terminal disclaimer.

(21) Appl. No.: 15/605,514

(22) Filed: May 25, 2017

(65) Prior Publication Data

US 2017/0345390 A1 Nov. 30, 2017

(30) Foreign Application Priority Data

May 27, 2016 (JP) ..... 2016-106502

(51) Int. Cl.
*G09G 5/02* (2006.01)

(52) U.S. Cl.
CPC ..... *G09G 5/02* (2013.01); *G09G 2320/0666* (2013.01)

(58) Field of Classification Search
CPC ..... G09G 2320/0276; G09G 2310/027; G09G 2320/0666; G09G 2320/0673;
(Continued)

(56) References Cited

U.S. PATENT DOCUMENTS 5,828,781 A * 10/1998 Nakano ..... H04N 1/6027 382/167
8,064,112 B1 * 11/2011 Bernasconi ..... H04N 1/644 347/115

(Continued)

FOREIGN PATENT DOCUMENTS

| | | | |
|---|---|---|---|
| JP | 2002116750 | A | 4/2002 |
| JP | 2008040305 | A | 2/2008 |
| JP | 2008141723 | A | 6/2008 |

*Primary Examiner* — Sultana M Zalalee
(74) *Attorney, Agent, or Firm* — Patterson + Sheridan

(57) ABSTRACT

A color adjustment circuit includes: a correction processing circuit configured to generate an output image data by performing color adjustment correction on an input image data; and a correction factor calculation circuit configured to calculate correction factors used for the color adjustment correction. The correction factor calculation circuit calculates a white color distance, a complementary color distance, and an elementary color distance and calculates the correction factors based on the white color distance, the complementary color distance and the elementary color distance. The correction factors are calculated based on: white point correction parameters, top correction parameters, and intermediate correction parameters. The intermediate correction parameters are defined to control the R, G, and B grayscale values of the output image data for the case when the input image data corresponds to each of elementary colors R, G, and B, and complementary colors C, M, and Y of an intermediate grayscale value.

20 Claims, 9 Drawing Sheets

(58) Field of Classification Search
CPC .... G09G 3/2003; G09G 5/02; G09G 2360/16; G09G 3/36; G09G 3/3607
See application file for complete search history.

(56) References Cited

U.S. PATENT DOCUMENTS

| | | | | |
|---|---|---|---|---|
| 8,427,411 | B2 * | 4/2013 | Tomizawa | G09G 5/02 345/690 |
| 9,837,045 | B2 * | 12/2017 | Furihata | G09G 3/36 |
| 2003/0117414 | A1 * | 6/2003 | Sasaki | G09G 3/006 345/589 |
| 2005/0190967 | A1 * | 9/2005 | Ok | H04N 1/54 382/167 |
| 2006/0139368 | A1 | 6/2006 | Kinoshita et al. | |
| 2009/0002785 | A1 * | 1/2009 | Marcu | G09G 5/02 358/525 |
| 2011/0169856 | A1 * | 7/2011 | Park | G09G 3/3607 345/589 |
| 2013/0155121 | A1 * | 6/2013 | Kang | H04N 9/73 345/690 |
| 2014/0002481 | A1 * | 1/2014 | Broughton | G09G 5/02 345/591 |
| 2014/0160176 | A1 * | 6/2014 | Nose | G09G 3/3406 345/690 |
| 2016/0225326 | A1 * | 8/2016 | Fiske | G09G 3/3413 |
| 2016/0253981 | A1 * | 9/2016 | Matsui | H04N 1/6027 345/690 |
| 2016/0261860 | A1 * | 9/2016 | Gu | G09G 3/006 |
| 2017/0200405 | A1 * | 7/2017 | Li | H04N 1/60 |

* cited by examiner

Fig. 3

| COLOR | F** | RGB VALUE |
|---|---|---|
| RED (R) | $\{F_r^R, F_r^G, F_r^B\}$ | {255, 0, 0} |
| GREEN (G) | $\{F_g^R, F_g^G, F_g^B\}$ | {0, 255, 0} |
| BLUE (B) | $\{F_b^R, F_b^G, F_b^B\}$ | {0, 0, 255} |
| CYAN (C) | $\{F_c^R, F_c^G, F_c^B\}$ | {0, 255, 255} |
| MAGENTA (M) | $\{F_m^R, F_m^G, F_m^B\}$ | {255, 0, 255} |
| YELLOW (Y) | $\{F_y^R, F_y^G, F_y^B\}$ | {255, 255, 0} |

Fig. 4

WHITE POINT CORRECTION PARAMETERS

| COLOR | T** |
|---|---|
| WHITE (W) | $\{T_w^R, T_w^G, T_w^B\}$ |

Fig. 5

INTERMEDIATE CORRECTION PARAMETERS

| COLOR | T** |
|---|---|
| RED (R) | $\{T_r^R, T_r^G, T_r^B\}$ |
| GREEN (G) | $\{T_g^R, T_g^G, T_g^B\}$ |
| BLUE (B) | $\{T_b^R, T_b^G, T_b^B\}$ |
| CYAN (C) | $\{T_c^R, T_c^G, T_c^B\}$ |
| MAGENTA (M) | $\{T_m^R, T_m^G, T_m^B\}$ |
| YELLOW (Y) | $\{T_y^R, T_y^G, T_y^B\}$ |

Fig. 6

TOP CORRECTION PARAMETERS

| COLOR | T'** |
|---|---|
| RED (R) | $\{T'_r{}^R, T'_r{}^G, T'_r{}^B\}$ |
| GREEN (G) | $\{T'_g{}^R, T'_g{}^G, T'_g{}^B\}$ |
| BLUE (B) | $\{T'_b{}^R, T'_b{}^G, T'_b{}^B\}$ |
| CYAN (C) | $\{T'_c{}^R, T'_c{}^G, T'_c{}^B\}$ |
| MAGENTA (M) | $\{T'_m{}^R, T'_m{}^G, T'_m{}^B\}$ |
| YELLOW (Y) | $\{T'_y{}^R, T'_y{}^G, T'_y{}^B\}$ |

DEVICE AND METHOD FOR DISPLAY COLOR ADJUSTMENT

CROSS-REFERENCE TO RELATED APPLICATION

This application claims priority to Japanese Patent Application No. 2016-106502, filed on May 27, 2016, the disclosure of which is incorporated herein by reference in its entirety.

TECHNICAL FIELD

The present disclosure relates to a color adjustment method, color adjustment apparatus, display driver and display system, more particularly, to a method and device for display color adjustment of a display apparatus.

BACKGROUND ART

Display apparatuses have often to be adapted to display color adjustment. A typical display color adjustment includes adjustment of the color gamut. As known in the art, sRGB, AdobeRGB, NTSC (National Television System Committee) are typical display device specifications and these specifications individually specify the color gamut, that is, the chromaticity coordinates of the elementary color points (R, G and B) and the white point. A display apparatus is preferably adjusted to display the respective elementary color points and the white point with the chromaticity coordinates specified by the specifications supported by the display apparatus.

One known approach to achieve color adjustment is to perform digital processing on image data of images to be displayed.

One issue to be considered in color adjustment through digital processing is that a display apparatus usually has a non-linear input-output property. Such non-linear property is often referred to as gamma property. As is well known in the art, the gamma property of a display apparatus is represented by a gamma value γ in general. For a given gamma value γ, the output y of a display apparatus for an input x can be generally represented as the following function:

$$Y=K\cdot x^{\gamma}, \tag{1}$$

where K is a proportionality constant.

Accordingly, color adjustment through digital processing usually involves an operation on the basis of the gamma property of the display apparatus. One known approach is to perform a gamma conversion on image data, perform a color adjusting operation on the gamma-converted image data and then perform an inverse gamma conversion. For example, Japanese Patent Application Publication No. P2008-40305A discloses a color adjustment technique which involves serially performing: a gamma conversion, an RGB-XYZ conversion, an XYZ-LMS conversion, a color shade adjustment, an LMS-XYZ conversion and an inverse gamma conversion. Japanese Patent Application Publication No. P2008-141723A discloses a technique for converting YCbCr data into Adobe RGB data through an YCbCr-RGB conversion and an RGB-RGB conversion. This patent document discloses the RGB-RGB conversion involves a gamma conversion, a matrix operation, and an inverse gamma conversion. Japanese Patent Application Publication No. P2002-116750A discloses a technique for achieving a precise color correction with a simple circuit configuration. In the technique disclosed in this patent document, the color correction is achieved by serially performing a gamma conversion with an LUT (lookup table), a matrix operation, and an inverse gamma conversion with an LUT.

One issue is that a hardware circuit performing a gamma conversion and inverse-gamma conversion has an increased circuit size. The gamma conversion and inverse-gamma conversion include a power operation and a circuit to perform a power operation suffers from an increased circuit size. A technique to achieve a gamma conversion and inverse-gamma conversion by using an LUT (lookup table) may reduce the circuit size, compared with a technique using a circuit performing a power operation; however an LUT also has a relatively large circuit size and this approach does not provide a sufficient solution against the problem of the increase in the circuit size. The problem of the increase in the circuit size is especially serious in color adjustment in applications strongly requesting circuit size reduction, for example, in a display driver driving a display panel (e.g. a liquid crystal display panel and an OLED (organic light emitting diode) mounted on a mobile terminal).

As thus discussed, there is a technical need for achieving color adjustment on the basis of the gamma property of a display apparatus with a reduced circuit size.

It should be noted that International Publication No. WO2004/070699A discloses a technique that involves: dividing the color gamut of a display device into a plurality of regions with segments which connect the chromaticity coordinate points corresponding to the white color to those corresponding to the elementary color points and the complementary color points; determining which of the regions the chromaticity coordinate point corresponding to the input signal is positioned in; and correcting the RGB values of the input signal on the basis of suitable RGB correction values corresponding to the chromaticity coordinate points corresponding to the three vertices of the region in which the chromaticity coordinate point corresponding to the input signal is positioned.

SUMMARY

Therefore, one objective of the present disclosure is to achieve color adjustment on the basis of the gamma property of a display apparatus with a reduced circuit size. Other objectives and new features of the present disclosure would be understood by a person skilled in the art from the following disclosure.

In one embodiment, a color adjustment circuit includes: a correction processing circuit configured to generate an output image data by performing color adjustment correction on an input image data; and a correction factor calculation circuit configured to calculate correction factors used for the color adjustment correction. The correction factor calculation circuit includes: a white color distance calculation circuit configured to calculate a white color distance indicative of a degree of separation between a white point and an input-corresponding point in a color space, the input-corresponding point corresponding to the input image data; a complementary color distance calculation circuit configured to calculate a complementary color distance indicative of a degree of separation between the input-corresponding point and a closest complementary color point in the color space, the closest complementary color point being one of C, M, and Y complementary color points closest to the input-corresponding point in the color space; an elementary color distance calculation circuit configured to calculate an elementary color distance indicative of a degree of separation between the input-corresponding point and a closest elementary color point in the color space, the closest elementary color point being one of R, G, and B elementary color points closest to the input-corresponding point in the color space; and a factor calculation circuitry configured to calculate the correction factors based on the white color distance, the complementary color distance and the elementary color distance. The factor calculation circuitry is configured to calculate the correction factors based on: white point correction parameters specifying R, G, and B grayscale values of the output image data for a case when the input image data corresponds to the white point; top correction parameters specifying R, G, and B grayscale values of the output image data for a case when the input image data corresponds to each of the R, G, and B elementary color points and the C, M, and Y complementary color points; and intermediate correction parameters controlling R, G, and B grayscale values of the output image data for a case when the input image data corresponds to each of elementary colors R, G, and B and complementary colors C, M, and Y of an intermediate grayscale value.

The color adjustment circuit thus configured is especially suitable for use in a display driver which drives a display panel in a display apparatus.

The present disclosure effectively achieves color adjustment on the basis of the gamma property of a display apparatus with a reduced circuit size.

BRIEF DESCRIPTION OF THE DRAWINGS

FIG. 3 is a table schematically illustrating an example of contents of color definition data;

FIG. 4 is a table schematically illustrating an example of contents of white point correction parameters;

FIG. 5 is a table schematically illustrating an example of contents of intermediate correction parameters;

FIG. 6 is a table schematically illustrating an example of contents of top correction parameters;

DETAILED DESCRIPTION

Figure 1:
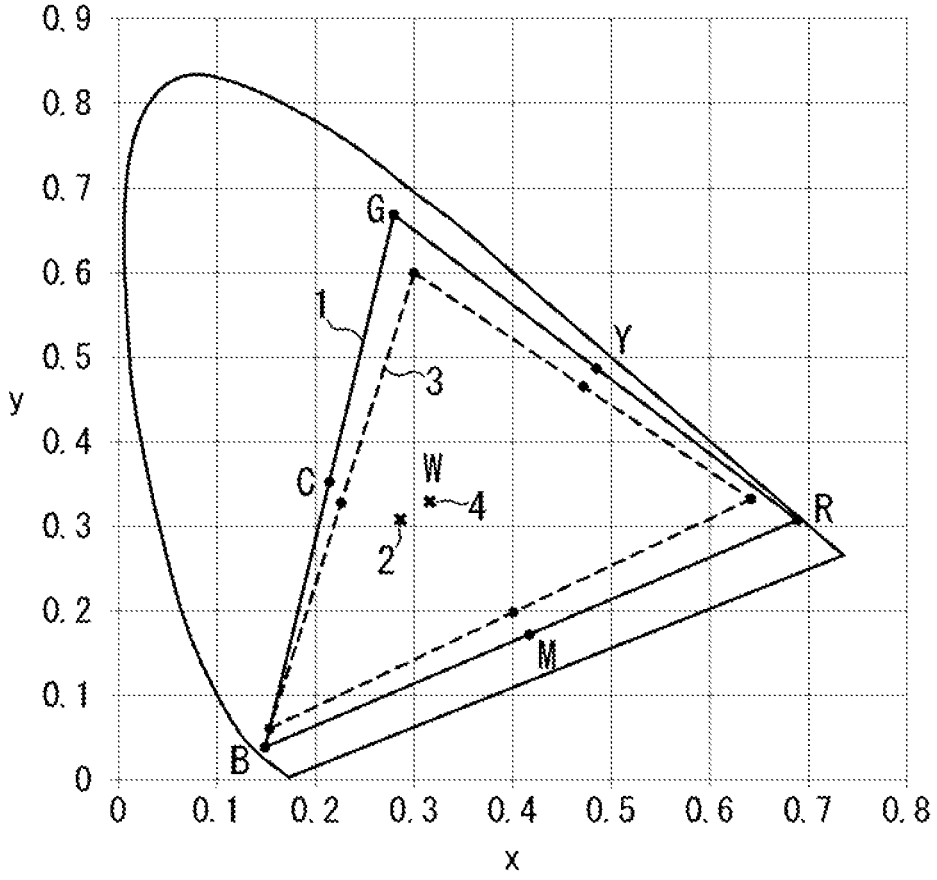
FIG. 1 is a chromaticity diagram illustrating color adjustment in one embodiment.

In the following, embodiments of the present disclosure will be described with reference to the attached drawings. It should be noted that same or similar elements may be denoted by same or corresponding reference numerals and suffixes may be attached with reference numerals to distinguish a plurality of same elements from each other.

FIG. 1 is a chromaticity diagram illustrating one example of color adjustment in one embodiment. In FIG. 1, the horizontal axis represents chromaticity coordinate x and the vertical axis represents chromaticity coordinate y. The color gamut and the white point are adjusted in the color adjustment of the present embodiment. The triangle denoted by the numeral 1 in FIG. 1 represents the original color gamut of a display apparatus and the numeral 2 denotes the chromaticity coordinates (x, y) of the white point of the display apparatus. The chromaticity coordinates (x, y) of the white point 2 of the display apparatus referred herein means the chromaticity coordinates (x, y) of the color displayed on the display apparatus when an image data corresponding to the white point (that is, an image data corresponding to the white color of the allowed maximum grayscale value) is supplied to the display apparatus.

In the color adjustment of the present embodiment, digital processing is performed for color adjustment so that a desired color gamut and desired chromaticity coordinates of the white point (for example, the color gamut and white point specified by the sRGB specification) are achieved in displaying images on the display apparatus. In FIG. 1, the triangle denoted by the numeral 3 represents the desired color gamut and the numeral 4 denotes the desired chromaticity coordinates (x, y) of the white point. In the following, a description is given of embodiments of a color adjustment circuit configured to achieve such color adjustment.

Figure 2:
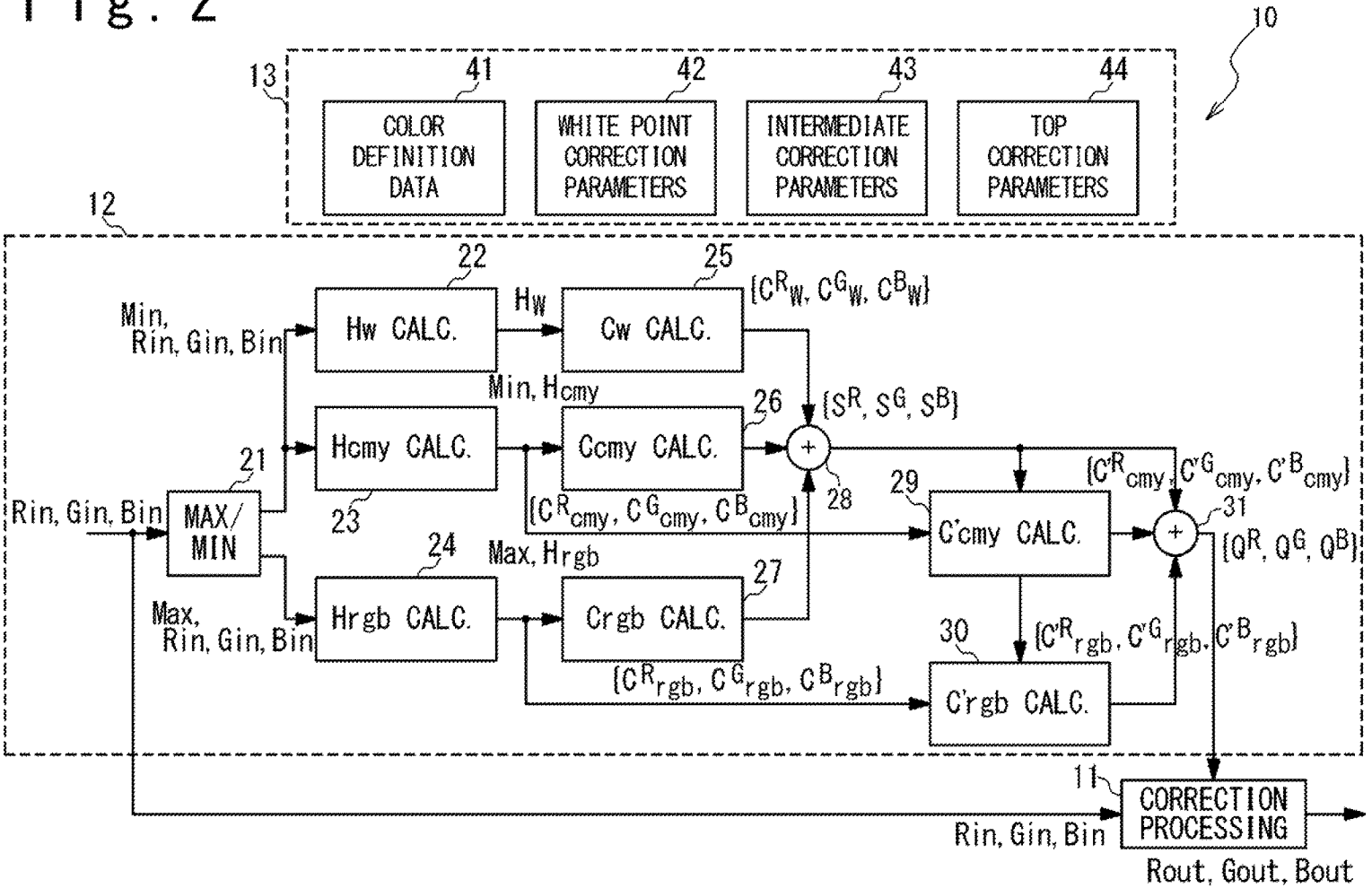
FIG. 2 is a block diagram illustrating an exemplary configuration of a color adjustment circuit in the present embodiment.

FIG. 2 is a block diagram illustrating an exemplary configuration of the color adjustment circuit 10 in the present embodiment. Overall, the color adjustment circuit 10 includes the correction processing circuit 11, a correction factor calculation circuit 12, and a register circuit 13.

The correction processing circuit 11 is configured to receive an input image data and generate an output image data by performing a color adjustment correction on the input image data. The input image data includes an R grayscale value Rin indicative of the grayscale level of the elementary color R, a G grayscale value Gin indicative of the grayscale level of the elementary color G, and a B grayscale value Bin indicative of the grayscale level of the elementary color B. Similarly, the output image data includes an R grayscale value Rout indicative of the grayscale level of the elementary color R, a G grayscale value Gout indicative of the grayscale level of the elementary color G, and a B grayscale value Bout indicative of the grayscale level of the elementary color B. Hereinafter, the R grayscale value, G grayscale value, and B grayscale value may be collectively referred to as RGB grayscale values. The RGB grayscale values Rout, Gout, and Bout of the output image data are calculated by performing digital processing on the RGB grayscale values Rin, Gin, and Bin of the input image data, in response to correction factors $Q^R$, $Q^G$, and $Q^B$ received from the correction factor calculation circuit 12.

It should be noted that a set of data having values respectively associated with the elementary colors R, G, and B may be referred to as {R, G, B}. Especially, a set of R, G, and B grayscale values may be collectively referred to as RGB grayscale values {R, G, B}. For example, the R grayscale value Rin, G grayscale value Gin, and B grayscale value Bin of an input image data may be collectively referred to as RGB grayscale values {Rin, Gin, Bin} and the R grayscale value Rout, G grayscale value Gout, and B grayscale value Bout of an output image data may be collectively referred to as RGB grayscale values {Rout, Gout, Bout}. The correction factors $Q^R$, $Q^G$, and $Q^B$, which are associated with the elementary colors R, G, and B, respectively, may be referred to as correction factors {$Q^R$, $Q^G$, $Q^B$}.

The correction factor calculation circuit 12 calculates the correction factors {$Q^R$, $Q^G$, $Q^B$} from the RGB grayscale values {Rin, Gin, Bin} of the input image data and various parameters stored in the register circuit 13. The correction factors {$Q^R$, $Q^G$, $Q^B$} are supplied to the correction processing circuit 11 and used for color adjustment correction in the correction processing circuit 11. The configuration and operation of the correction factor calculation circuit 12 will be described later in detail.

The register circuit 13 includes a set of registers storing various parameters used for calculating the correction factors {$Q^R$, $Q^G$, $Q^B$}. In the present embodiment, the register circuit 13 includes a color definition data register 41, a white point correction parameter register 42, an intermediate correction parameter register 43, and a top correction parameter register 44.

The color definition data register 41 stores therein color definition data which define the R elementary color point, G elementary color point, B elementary color point, C complementary color point, M complementary color point, and Y complementary color point. FIG. 3 is a table schematically illustrates an example of the contents of the color definition data. In the present embodiment, the color definition data includes parameters listed below:

(1) R elementary color point definition parameters Fr{$Fr^R$, $Fr^G$, $Fr^B$} which define the RGB grayscale values of the R elementary color point for the input image data;

(2) G elementary color point definition parameters Fg{$Fg^R$, $Fg^G$, $Fg^B$} which define the RGB grayscale values of the G elementary color point for the input image data;

(3) B elementary color point definition parameters Fb{$Fb^R$, $Fb^G$, $Fb^B$} which define the RGB grayscale values of the B elementary color point for the input image data;

(4) C complementary color point definition parameters Fc{$Fc^R$, $Fc^G$, $Fc^B$} which define the RGB grayscale values of the C complementary color point for the input image data;

(5) M complementary color point definition parameters Fm{$Fm^R$, $Fm^G$, $Fm^B$} which define the RGB grayscale values of the M complementary color point for the input image data; and (6) Y complementary color point definition parameters Fy{$Fy^R$, $Fy^G$, $Fy^B$} which define the RGB grayscale values of the Y complementary color point for the input image data.

The rightmost column of the table of FIG. 3 illustrates a specific example of the values of the color definition data. Illustrated in FIG. 3 is an example in which the R, G, and B grayscale values are represented by eight-bit values. Most typically, the color definition data specify the RGB grayscale values {$Fr^R$, $Fr^G$, $Fr^B$} of the R elementary color point as {255, 0, 0}. In other words, the R elementary color point is defined as having an R grayscale value of the allowed maximum grayscale value, a G grayscale value of the allowed minimum grayscale value, and a B grayscale value of the allowed minimum grayscale value. Similarly, the color definition data specifies the RGB grayscale values {$Fg^R$, $Fg^G$, $Fg^B$} of the G elementary color point as {0, 255, 0} and the RGB grayscale values {$Fb^R$, $Fb^G$, $Fb^B$} of the B elementary color point as {0, 0, 255}. Also, the color definition data specify the RGB grayscale values {$Fc^R$, $Fc^G$, $Fc^B$} of the C complementary color point as {0, 255, 255}, the RGB grayscale values {$Fm^R$, $Fm^G$, $Fm^B$} of the M complementary color point as {255, 0, 255} and the RGB grayscale values {$Fy^R$, $Fy^G$, $Fy^B$} of the Y complementary color point as {255, 255, 0}. Such definition is one of the most typical definitions of the R elementary color point, G elementary color point, B elementary color point, C complementary color point, M complementary color point, and Y complementary color point, The white point correction parameter register 42 stores therein white point correction parameters Tw. As illustrated in FIG. 4, in the present embodiment, the white point correction parameters Tw include RGB grayscale values {$Tw^R$, $Tw^G$, $Tw^B$} specifying the RGB values {Rout, Gout, Bout} of the output image data which is output from the correction processing circuit 11 when an input image data corresponding to the white point (that is, an input image data for which the R, G and B grayscale values are all specified as the allowed maximum grayscale value (e.g. 255)) is supplied to the correction processing circuit 11. As described later in detail, the correction factors {$Q^R$, $Q^G$, $Q^B$} are calculated so that the RGB grayscale values {Rout, Gout, Bout} of the output image data are calculated as grayscale values {$Tw^R$, $Tw^G$, $Tw^B$}, respectively, when the input image data corresponding to the white point is supplied to the correction processing circuit 11.

The intermediate correction parameter register 43 stores therein intermediate correction parameters controlling the RGB grayscale values {Rout, Gout, Bout} of the output image data calculated in response to an input image data corresponding to each of the elementary colors R, G, and B and the complementary colors C, M, and Y of an intermediate grayscale value, more strictly, in response to an input image data having R, G, and B grayscale values between the allowed minimum grayscale value and the R, G, and B grayscale values defined for the elementary color points and complementary color points, where the ratio of the R, G, and B grayscale values of the input image data is the same as that of the R, G, and B grayscale values defined for each of the elementary color points and complementary color points. It should be noted that, when the R, G, or B grayscale value defined for an elementary or complementary color is equal to the allowed minimum grayscale value, the "value between the allowed minimum grayscale value and the R, G, or B grayscale value defined for the elementary or complementary color" should be understood as being equal to the allowed minimum grayscale value. In the present embodiment, the respective elementary color points and complementary color points are defined by the color definition data stored in the color definition data register 41; however, the definitions of the respective elementary color points and complementary color points may be determined by the specifications of the color adjustment circuit 10. In this case, it is unnecessary for the color adjustment circuit 10 to store therein the color definition data, which defines the respective elementary color points and complementary color points. The intermediate correction parameters are used to control the input-output property of the correction processing circuit 11 for intermediate grayscale values. In the present embodiment, as illustrated in FIG. 5, the intermediate correction parameters stored in the intermediate correction parameter register 43 include parameters listed below:

(1) R intermediate color correction parameters Tr{$Tr^R$, $Tr^G$, $Tr^B$} controlling the RGB grayscale values {Rout, Gout, Bout} of the output image data calculated in response to an input image data corresponding to the elementary color R of an intermediate grayscale value (that is, an input image data having R, G, and B grayscale values between the allowed minimum grayscale value and the R, G, and B grayscale values defined for the R elementary color point, where the ratio of the R, G, and B grayscale values of the input image data are equal to that of the R, G, and B grayscale values defined for the R elementary color point);

(2) G intermediate color correction parameters Tg{$Tg^R$, $Tg^G$, $Tg^B$} controlling the RGB grayscale values {Rout, Gout, Bout} of the output image data calculated in response to an input image data corresponding to the elementary color G of an intermediate grayscale value (that is, an input image data having R, G, and B grayscale values between the allowed minimum grayscale value and the R, G, and B grayscale values defined for the G elementary color point, where the ratio of the R, G, and B grayscale values of the input image data are equal to that of the R, G, and B grayscale values defined for the G elementary color point);

(3) B intermediate color correction parameters Tb{$Tb^R$, $Tb^G$, $Tb^B$} controlling the RGB grayscale values {Rout, Gout, Bout} of the output image data calculated in response to an input image data corresponding to the elementary color B of an intermediate grayscale value (that is, an input image data having R, G, and B grayscale values between the allowed minimum grayscale value and the R, G, and B grayscale values defined for the B elementary color point, where the ratio of the R, G, and B grayscale values of the input image data are equal to that of the R, G, and B grayscale values defined for the B elementary color point);

(4) C intermediate color correction parameters Tc{$Tc^R$, $Tc^G$, $Tc^B$} controlling the RGB grayscale values {Rout, Gout, Bout} of the output image data calculated in response to an input image data corresponding to the complementary color C of an intermediate grayscale value (that is, an input image data having R, G, and B grayscale values between the allowed minimum grayscale value and the R, G, and B grayscale values defined for the C complementary color point, where the ratio of the R, G, and B grayscale values of the input image data are equal to that of the R, G, and B grayscale values defined for the C complementary color point);

(5) M intermediate color correction parameters Tm{$Tm^R$, $Tm^G$, $Tm^B$} controlling the RGB grayscale values {Rout, Gout, Bout} of the output image data calculated in response to an input image data corresponding to the complementary color M of an intermediate grayscale value (that is, an input image data having R, G, and B grayscale values between the allowed minimum grayscale value and the R, G, and B grayscale values defined for the M complementary color point, where the ratio of the R, G, and B grayscale values of the input image data are equal to that of the R, G, and B grayscale values defined for the M complementary color point);

(6) Y intermediate color correction parameters Ty{$Ty^R$, $Ty^G$, $Ty^B$} controlling the RGB grayscale values {Rout, Gout, Bout} of the output image data calculated in response to an input image data corresponding to the complementary color Y of an intermediate grayscale value (that is, an input image data having R, G, and B grayscale values between the allowed minimum grayscale value and the R, G, and B grayscale values defined for the Y complementary color point, where the ratio of the R, G, and B grayscale values of the input image data are equal to that of the R, G, and B grayscale values defined for the Y complementary color point);

By controlling the R intermediate color correction parameters Tr{$Tr^R$, $Tr^G$, $Tr^B$}, for example, it is possible to control the RGB grayscale values {Rout, Gout, Bout} of the output image data calculated in response to an input image data corresponding to the elementary color R of an intermediate grayscale value. The similar goes for the G intermediate color correction parameters Tg, B intermediate color correction parameters Tb, C intermediate color correction parameters Tc, M intermediate color correction parameters Tm, and Y intermediate color correction parameters Ty.

The top correction parameter register 44 stores therein top correction parameters specifying the RGB grayscale values {Rout, Gout, Bout} of the output image data to be output from the correction processing circuit 11, when input image data corresponding to the R, G, and B elementary color points and C, M, and Y complementary color points are supplied to the correction processing circuit 11. It should be noted that the R, G, and B elementary color points and C, M, and Y complementary color points are defined by the color definition data stored in the color definition data register 41 (see FIG. 3). In the present embodiment, as illustrated in FIG. 6, the top correction parameter register 44 stores therein parameters listed below:

(1) R elementary color point correction parameters T'r{$T'r^R$, $T'r^G$, $T'r^B$} specifying the RGB grayscale values {Rout, Gout, Bout} of the output image data to be output from the correction processing circuit 11 when an input image data corresponding to the R elementary color point is supplied to the correction processing circuit 11;

(2) G elementary color point correction parameters T'g{$T'g^R$, $T'g^G$, $T'g^B$} specifying the RGB grayscale values {Rout, Gout, Bout} of the output image data to be output from the correction processing circuit 11 when an input image data corresponding to the G elementary color point is supplied to the correction processing circuit 11;

(3) B elementary color point correction parameters T'b{$T'b^R$, $T'b^G$, $T'b^B$} specifying the RGB grayscale values {Rout, Gout, Bout} of the output image data to be output from the correction processing circuit 11 when an input image data corresponding to the B elementary color point is supplied to the correction processing circuit 11;

(4) C complementary color point correction parameters T'c{$T'c^R$, $T'c^G$, $T'c^B$} specifying the RGB grayscale values {Rout, Gout, Bout} of the output image data to be output from the correction processing circuit 11 when an input image data corresponding to the C complementary color point is supplied to the correction processing circuit 11;

(5) M complementary color point correction parameters T'm{$T'm^R$, $T'm^G$, $T'm^B$} specifying the RGB grayscale values {Rout, Gout, Bout} of the output image data to be output from the correction processing circuit 11 when an input image data corresponding to the M complementary color point is supplied to the correction processing circuit 11; and (6) Y complementary color point correction parameters T'y{$T'y^R$, $T'y^G$, $T'y^B$} specifying the RGB grayscale values {Rout, Gout, Bout} of the output image data to be output from the correction processing circuit 11 when an input image data corresponding to the Y complementary color point is supplied to the correction processing circuit 11.

It should be noted that the input image data corresponding to the R elementary color point means to an input image data having RGB grayscale values equal to the RGB grayscale values {$Fr^R$, $Fr^G$, $Fr^B$} described as the R elementary color definition parameter Fr in the color definition data. For example, when the RGB grayscale values {Rin, Gin, Bin} of an input image data are equal to the RGB grayscale values {$Fr^R$, $Fr^G$, $Fr^B$}, the RGB grayscale values {Rout, Gout, Bout} of the output image data are calculated as the RGB grayscale values {$T'r^R$, $T'r^G$, $T'r^B$} specified by the R elementary color point correction parameter T'r.

The same goes for other elementary colors and complementary colors. The input image data corresponding to the G elementary color point means to an input image data having RGB grayscale values equal to the RGB grayscale values $\{Fg^R, Fg^G, Fg^B\}$ described as the G elementary color definition parameter Fg in the color definition data and the input image data corresponding to the B elementary color point means to an input image data having RGB grayscale values equal to the RGB grayscale values $\{Fb^R, Fb^G, Fb^B\}$ described as the B elementary color definition parameter Fb in the color definition data. Similarly, the input image data corresponding to the C complementary color point means to an input image data having RGB grayscale values equal to the RGB grayscale values $\{Fc^R, Fc^G, Fc^B\}$ described as the C complementary color definition parameter Fc in the color definition data. Finally, the input image data corresponding to the M complementary color point means to an input image data having RGB grayscale values equal to the RGB grayscale values $\{Fm^R, Fm^G, Fm^B\}$ described as the M complementary color definition parameter Fm in the color definition data and the input image data corresponding to the Y complementary color point means to an input image data having RGB grayscale values equal to the RGB grayscale values $\{Fy^R, Fy^G, Fy^B\}$ described as the Y complementary color definition parameter Fy in the color definition data.

Next, a detailed description is given of the configuration and operation of the correction factor calculation circuit 12. Referring back to FIG. 2, the correction factor calculation circuit 12 includes a maximum-minimum determination circuit 21, a white color distance calculation circuit 22, a complementary color distance calculation circuit 23, an elementary color distance calculation circuit 24, a white color correction term calculation circuit 25, a complementary color intermediate correction term calculation circuit 26, an elementary color intermediate correction term calculation circuit 27, an adder 28, a complementary color top correction term calculation circuit 29, an elementary color top correction term calculation circuit 30 and an adder 31.

The maximum-minimum determination circuit 21 determines which of the RGB grayscale values {Rin, Gin, Bin} of the input image data are the largest and smallest and generate a data Max indicating which of the RGB grayscale values {Rin, Gin, Bin} is the largest and a data Min indicating which is the smallest.

Figure 7:
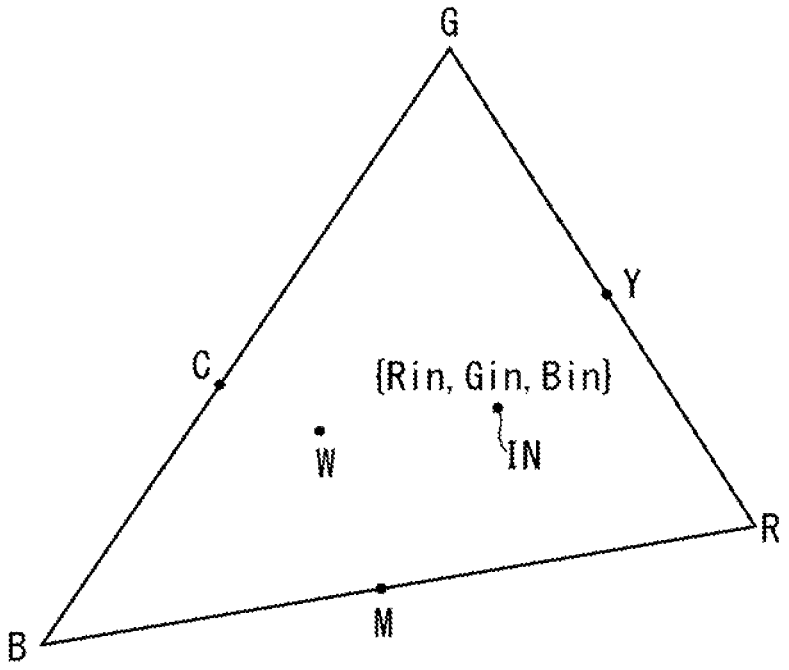
FIG. 7 illustrates an example of the positional relationship of the input-corresponding point corresponding to an input image data, to the white point, the R elementary color point, the G elementary color point, the B elementary color point, the C complementary color point, the M complementary color point and Y complementary color point.

It should be noted that this process is equivalent to a process to determine the elementary color point (R, G, or B elementary color point) closest to the point corresponding to the input image data in the color space (which may be referred to as "input-corresponding point", hereinafter) and the complementary color point (C, M, or Y complementary color point) closest to the input-corresponding point. FIG. 7 illustrates an example of the positional relationship of the input-corresponding point corresponding to the input image data, to the R elementary color point, G elementary color point, B elementary color point, C complementary color point, M complementary color point and Y complementary color point. The legend "IN" denotes the input-corresponding point in FIG. 7. When Rin is the largest of the RGB grayscale values {Rin, Gin, Bin} and Bin is the smallest as illustrated in FIG. 7, for example, the elementary color point closest to the input-corresponding point corresponding to the input image data is the R elementary color point and the complementary color point closest to the input-corresponding point is the Y complementary color point. In the following, the elementary color point closest to the input-corresponding point in the color space may be referred to as closest elementary color point and the complementary color point closest to the input-corresponding point in the color space may be referred to as closest complementary color point.

The white color distance calculation circuit 22 calculates a white color distance Hw. The white color distance Hw is a parameter indicative of the degree of separation between the white point and the input-corresponding point, which corresponds to the input image data, in the color space. In the present embodiment, the white color distance Hw is calculated in accordance with the following expression (1):

$$Hw = RGB_{MAX} - \min(Rin, Gin, Bin), \tag{1}$$

where $RGB_{MAX}$ is the allowed maximum grayscale value of the input image data, which is represented as a number of $2^n-1$ for n being an integer two or more. When the RGB grayscale values {Rin, Gin, Bin} of the input image data are described as eight-bit data, $RGB_{MAX}$ is "255." Note that min (x, y, z) is the function which gives the minimum value of x, y, and z.

The complementary color distance calculation circuit 23 calculates a complementary color distance Hcmy, which is a parameter indicative of the degree of separation between the above-described closest complementary color point and the input-corresponding point, which corresponds to the input image data, in the color space. In the present embodiment, the complementary color distance Hcmy is calculated in accordance with the following expression (2):

$$Hcmy = RGB_{MAX} - (\mathrm{Max}Dcmy - \mathrm{Min}Dcmy), \tag{2}$$

where MaxDcmy and MinDcmy are defined by the following expressions (3a) to (3e):

$$Dcmy^R = \begin{cases} Rin - Fc^R & \text{if } \mathrm{Min} = Rin, \\ Rin - Fm^R & \text{if } \mathrm{Min} = Gin,, \\ Rin - Fy^R & \text{if } \mathrm{Min} = Bin \end{cases} \tag{3a}$$

$$Dcmy^G = \begin{cases} Gin - Fc^G & \text{if } \mathrm{Min} = Rin, \\ Gin - Fm^G & \text{if } \mathrm{Min} = Gin,, \\ Gin - Fy^G & \text{if } \mathrm{Min} = Bin \end{cases} \tag{3b}$$

$$Dcmy^B = \begin{cases} Bin - Fc^B & \text{if } \mathrm{Min} = Rin, \\ Bin - Fm^B & \text{if } \mathrm{Min} = Gin,, \\ Bin - Fy^B & \text{if } \mathrm{Min} = Bin \end{cases} \tag{3c}$$

$$\mathrm{Max}Dcmy = \max(Dcmy^R, Dcmy^G, Dcmy^B), \text{ and} \tag{3d}$$

$$\mathrm{Min}Dcmy = \min(Dcmy^R, Dcmy^G, Dcmy^B). \tag{3e}$$

It should be noted that the notation "if Min=Rin" means the case when the R grayscale value Rin is the smallest of the RGB grayscale values {Rin, Gin, Bin} of the input image data. Similarly, the notation "if Min=Gin" means the case when the G grayscale value Gin is the smallest of the RGB grayscale values {Rin, Gin, Bin} of the input image data and the notation "if Min=Bin" means the case when the B grayscale value Bin is the smallest of the RGB grayscale values {Rin, Gin, Bin} of the input image data. The RGB grayscale values $\{Fc^R, Fc^G, Fc^B\}$ are described as the C complementary color definition parameters in the above-described color definition data, the RGB grayscale values $\{Fm^R, Fm^G, Fm^B\}$ are described as the M complementary color definition parameters in the above-described color definition data, and the RGB grayscale values $\{Fy^R, Fy^G, Fy^B\}$ are described as the Y complementary color definition parameters in the above-described color definition data.

The elementary color distance calculation circuit 24 calculates an elementary color distance Hrgb, which is a parameter indicative of the degree of separation between the above-described closest elementary color point and the input-corresponding point, which corresponds to the input image data, in the color space. In the present embodiment, the elementary color distance Hrgb is calculated in accordance with the following expression (4):

$$Hrgb=RGB_{MAX}-(\mathrm{Max}Drgb-\mathrm{Min}Drgb), \tag{4}$$

where MaxDrgb and MinDrgb are defined by the following expressions (5a) to (5e):

$$Drgb^R=\begin{cases} Rin-Fr^R & \text{if Max}=Rin, \\ Rin-Fg^R & \text{if Max}=Gin,, \\ Rin-Fb^R & \text{if Max}=Bin \end{cases} \tag{5a}$$

$$Drgb^G=\begin{cases} Gin-Fr^G & \text{if Max}=Rin, \\ Gin-Fg^G & \text{if Max}=Gin,, \\ Gin-Fb^G & \text{if Max}=Bin \end{cases} \tag{5b}$$

$$Drgb^B=\begin{cases} Bin-Fr^B & \text{if Max}=Rin, \\ Bin-Fg^B & \text{if Max}=Gin,, \\ Bin-Fb^B & \text{if Max}=Bin \end{cases} \tag{5c}$$

$$\mathrm{Max}Drgb=\max(Drgb^R, Drgb^G, Drgb^B), \text{ and} \tag{5d}$$

$$\mathrm{Min}Drgb=\min(Drgb^R, Drgb^G, Drgb^B). \tag{5e}$$

It should be noted that the notation "if Max=Rin" means the case when the R grayscale value Rin is the largest of the RGB grayscale values {Rin, Gin, Bin} of the input image data. Similarly, the notation "if Max=Gin" means the case when the G grayscale value Gin is the largest of the RGB grayscale values {Rin, Gin, Bin} of the input image data and the notation "if Max=Bin" means the case when the B grayscale value Bin is the largest of the RGB grayscale values {Rin, Gin, Bin} of the input image data. The RGB grayscale values {$Fr^R$, $Fr^G$, $Fr^B$} are described as the R elementary color definition parameters in the above-described color definition data, the RGB grayscale values {$Fg^R$, $Fg^G$, $Fg^B$} are described as the G elementary color definition parameters in the above-described color definition data, and the RGB grayscale values {$Fb^R$, $Fb^G$, $Fb^B$} are described as the B elementary color definition parameters in the above-described color definition data.

The white color correction term calculation circuit 25, the complementary color intermediate correction term calculation circuit 26, the elementary color intermediate correction term calculation circuit 27, the adder 28, the complementary color top correction term calculation circuit 29, the elementary color top correction term calculation circuit 30 and the adder 31 form a factor calculation circuitry which calculates correction factors {$Q^R$, $Q^G$, $Q^B$} on the basis of the white point correction parameters Tw, the intermediate correction parameters and the top correction parameters (these are stored in the register circuit 13), the white color distance Hw, the complementary color distance Hcmy, and the elementary color distance Hrgb.

More specifically, the white color correction term calculation circuit 25 calculates white color correction terms {$C^R$w, $C^G$w, $C^B$w}, which are terms included in the correction factors {$Q^R$, $Q^G$, $Q^B$} used in the correction performed by the correction processing circuit 11. The white color correction terms {$C^R$w, $C^G$w, $C^B$w} depend on the white point correction parameters Tw{$Tw^R$, $Tw^G$, $Tw^P$} stored in the white point correction parameter register 42 and the white color distance Hw calculated by the white color distance calculation circuit 22. In the present embodiment, the white color correction terms {$C^R$w, $C^G$w, $C^B$w} are calculated in accordance with the following expressions (6a) to (6c):

$$C^Rw=Hw\times(Tw^R-RGB_{MAX}), \tag{6a}$$

$$C^Gw=Hw\times(Tw^G-RGB_{MAX}), \text{ and} \tag{6b}$$

$$C^Bw=Hw\times(Tw^B-RGB_{MAX}). \tag{6c}$$

The complementary color intermediate correction term calculation circuit 26 calculates complementary color intermediate correction terms {$C^R$cmy, $C^G$cmy, $C^B$cmy}, which are terms included in the correction factors {$Q^R$, $Q^G$, $Q^B$} used in the correction performed by the correction processing circuit 11. The complementary color intermediate correction terms {$C^R$cmy, $C^G$cmy, $C^B$cmy} depend on the C intermediate color correction parameters Tc, the M intermediate color correction parameters Tm, the Y intermediate color correction parameters Ty (these are stored in the intermediate correction parameter register 43), and the complementary color distance Hcmy calculated by the complementary color distance calculation circuit 23. In the present embodiment, the complementary color intermediate correction terms {$C^R$cmy, $C^G$cmy, $C^B$cmy} are calculated in accordance with the following expressions (7a) to (7c):

$$C^Rcmy=\begin{cases} Hcmy\times(Tc^R-Fc^R) & \text{if Min}=Rin, \\ Hcmy\times(Tm^R-Fm^R) & \text{if Min}=Gin,, \\ Hcmy\times(Ty^R-Fy^R) & \text{if Min}=Bin \end{cases} \tag{7a}$$

$$C^Gcmy=\begin{cases} Hcmy\times(Tc^G-Fc^G) & \text{if Min}=Rin, \\ Hcmy\times(Tm^G-Fm^G) & \text{if Min}=Gin,, \\ Hcmy\times(Ty^G-Fy^G) & \text{if Min}=Bin \end{cases} \tag{7b}$$

$$C^Bcmy=\begin{cases} Hcmy\times(Tc^B-Fc^B) & \text{if Min}=Rin, \\ Hcmy\times(Tm^B-Fm^B) & \text{if Min}=Gin, \text{ and} \\ Hcmy\times(Ty^B-Fy^B) & \text{if Min}=Bin \end{cases} \tag{7c}$$

The elementary color intermediate correction term calculation circuit 27 calculates elementary color intermediate correction terms {$C^R$rgb, $C^G$rgb, $C^B$rgb}, which are terms included in the correction factors {$Q^R$, $Q^G$, $Q^B$} used in the correction performed by the correction processing circuit 11. The elementary color intermediate correction terms {$C^R$rgb, $C^G$rgb, $C^B$rgb} depend on the R intermediate color correction parameters Tr, the G intermediate color correction parameters Tg, the B intermediate color correction parameters Tb (these are stored in the intermediate correction parameter register 43) and the elementary color distance Hrgb calculated by the elementary color distance calculation circuit 24. In the present embodiment, the elementary color intermediate correction terms {$C^R$rgb, $C^G$rgb, $C^B$rgb} are calculated in accordance with the following expressions (8a) to (8c):

$$C^Rrgb=\begin{cases} Hrgb\times(Tr^R-Fr^R) & \text{if Max}=Rin, \\ Hrgb\times(Tg^R-Fg^R) & \text{if Max}=Gin,, \\ Hrgb\times(Tb^R-Fb^R) & \text{if Max}=Bin \end{cases} \tag{8a}$$

-continued $$C^G rgb = \begin{cases} Hrgb \times (Tr^G - Fr^G) & \text{if Max} = Rin, \\ Hrgb \times (Tg^G - Fg^G) & \text{if Max} = Gin, , \\ Hrgb \times (Tb^G - Fb^G) & \text{if Max} = Bin \end{cases} \quad (8b)$$

$$C^R rgb = \begin{cases} Hrgb \times (Tr^B - Fr^B) & \text{if Max} = Rin, \\ Hrgb \times (Tg^B - Fg^B) & \text{if Max} = Gin, \text{ and }, \\ Hrgb \times (Tb^B - Fb^B) & \text{if Max} = Bin \end{cases} \quad (8c)$$

The adder 28 calculates sums $\{S^R, S^G, S^B\}$ in accordance with the following expressions (9a) to (9c):

$$S^R = C^R w + C^R cmy + C^R rgb, \quad (9a)$$

$$S^G = C^G w + C^G cmy + C^G rgb, \text{ and} \quad (9b)$$

$$S^B = C^B w + C^B cmy + C^B rgb. \quad (9c)$$

As is understood from these expressions, $S^R$ is the sum of the white color correction term $C^R$w, the complementary color intermediate correction term $C^R$cmy, and the elementary color intermediate correction term $C^R$rgb, which are associated with the elementary color R. Similarly, $S^G$ is the sum of the white color correction term $C^G$w, the complementary color intermediate correction term $C^G$cmy, and the elementary color intermediate correction term $C^G$rgb, which are associated with the elementary color G, and $S^B$ is the sum of the white color correction term $C^B$w, the complementary color intermediate correction term $C^B$cmy, and the elementary color intermediate correction term $C^B$rgb, which are associated with the elementary color B.

The complementary color top correction term calculation circuit 29 calculates complementary color top correction terms $\{C'^R\text{cmy}, C'^G\text{cmy}, C'^B\text{cmy}\}$, which are terms included in the correction factors $\{Q^R, Q^G, Q^B\}$ used in the correction performed by the correction processing circuit 11. The complementary color top correction terms $\{C'^R\text{cmy}, C'^G\text{cmy}, C'^B\text{cmy}\}$ depend on the C complementary color correction parameter T'c, the M complementary color correction parameter T'm, the Y complementary color correction parameter T'y (these are stored in the top correction parameter register 44), and the complementary color distance Hcmy calculated by the complementary color distance calculation circuit 23. In the present embodiment, the complementary color top correction terms $\{C'^R\text{cmy}, C'^G\text{cmy}, C'^B\text{cmy}\}$ are calculated in accordance with the following expressions (10a) to (10c):

$$C'^R cmy = \begin{cases} Hcmy \times \{T'c^R - Fc^R - S^R/(RGB_{MAX}+1)\} & \text{if Min} = Rin, \\ Hcmy \times \{T'm^R - Fm^R - S^R/(RGB_{MAX}+1)\} & \text{if Min} = Gin, , \\ Hcmy \times \{T'y^R - Fy^R - S^R/(RGB_{MAX}+1)\} & \text{if Min} = Bin \end{cases} \quad (10a)$$

$$C'^G cmy = \begin{cases} Hcmy \times \{T'c^G - Fc^G - S^G/(RGB_{MAX}+1)\} & \text{if Min} = Rin, \\ Hcmy \times \{T'm^G - Fm^G - S^G/(RGB_{MAX}+1)\} & \text{if Min} = Gin, , \\ Hcmy \times \{T'y^G - Fy^G - S^G/(RGB_{MAX}+1)\} & \text{if Min} = Bin \end{cases} \quad (10b)$$

$$C'^B cmy = \begin{cases} Hcmy \times \{T'c^B - Fc^B - S^B/(RGB_{MAX}+1)\} & \text{if Min} = Rin, \\ Hcmy \times \{T'm^B - Fm^B - S^B/(RGB_{MAX}+1)\} & \text{if Min} = Gin, \text{ and }, \\ Hcmy \times \{T'y^B - Fy^B - S^B/(RGB_{MAX}+1)\} & \text{if Min} = Bin \end{cases} \quad (10c)$$

The elementary color top correction term calculation circuit 30 calculates elementary color top correction terms $\{C'^R\text{rgb}, C'^G\text{rgb}, C'^B\text{rgb}\}$, which are terms included in the correction factors $\{Q^R, Q^G, Q^B\}$ used in the correction performed by the correction processing circuit 11. The elementary color top correction terms $\{C'^R\text{rgb}, C'^G\text{rgb}, C'^B\text{rgb}\}$ depend on the R elementary color point correction parameters T'r, the G elementary color point correction parameters T'g, the B elementary color point correction parameters T'b (these are stored in the top correction parameter register 44), and the elementary color distance Hrgb calculated by the elementary color distance calculation circuit 24. In the present embodiment, the elementary color top correction terms $\{C'^R\text{rgb}, C'^G\text{rgb}, C'^B\text{rgb}\}$ are calculated in accordance with the following expressions (11a) to (11c):

$$C'^R rgb = \begin{cases} Hrgb \times \{T'r^R - Fr^R - S^R/(RGB_{MAX}+1)\} & \text{if Max} = Rin, \\ Hrgb \times \{T'g^R - Fg^R - S^R/(RGB_{MAX}+1)\} & \text{if Max} = Gin, , \\ Hrgb \times \{T'b^R - Fb^R - S^R/(RGB_{MAX}+1)\} & \text{if Max} = Bin \end{cases} \quad (11a)$$

$$C'^G rgb = \begin{cases} Hrgb \times \{T'r^G - Fr^G - S^G/(RGB_{MAX}+1)\} & \text{if Max} = Rin, \\ Hrgb \times \{T'g^G - Fg^G - S^G/(RGB_{MAX}+1)\} & \text{if Max} = Gin, , \\ Hrgb \times \{T'b^G - Fb^G - S^G/(RGB_{MAX}+1)\} & \text{if Max} = Bin \end{cases} \quad (11b)$$

$$C'^B rgb = \begin{cases} Hrgb \times \{T'r^B - Fr^B - S^B/(RGB_{MAX}+1)\} & \text{if Max} = Rin, \\ Hrgb \times \{T'g^B - Fg^B - S^B/(RGB_{MAX}+1)\} & \text{if Max} = Gin, \text{ and }, \\ Hrgb \times \{T'b^B - Fb^B - S^B/(RGB_{MAX}+1)\} & \text{if Max} = Bin \end{cases} \quad (11c)$$

It should be noted that subtraction operations of subtracting values $S^R/(RGB_{MAX}+1)$, $S^G/(RGB_{MAX}+1)$ and $S^B/(RGB_{MAX}+1)$ are performed in expressions (10a) to (10c) and (11a) to (11c). This aims at partially cancelling the effect of the corrections performed with respect to the white point and intermediate grayscale values, from the complementary color top correction terms $\{C'^R\text{cmy}, C'^G\text{cmy}, C'^B\text{cmy}\}$ and the elementary color top correction terms $\{C'^R\text{rgb}, C'^G\text{rgb}, C'^B\text{rgb}\}$.

With respect to expression (10a), which is used to calculate the complementary color top correction term $C'^R$cmy, for example, the term "$-\text{Hcmy}\cdot S^R/(RGB_{MAX}+1)$" is introduced to partially cancel the effect of the correction with respect to the white point and intermediate grayscale values. In other words, an operation of subtracting the $\text{Hcmy}/(RGB_{MAX}+1)$ times of $S^R$ is performed in expression (10a). As described above, the sum $S^R$ is defined as the sum of the white color correction term $C^R$w, the complementary color intermediate correction term $C^R$cmy, and the elementary color intermediate correction term $C^R$rgb, which are associated with the elementary color R. This means that the Hcmy/($RGB_{MAX}$+1) times of the white color correction term $C^R$w, the complementary color intermediate correction term $C^R$cmy, and the elementary color intermediate correction term $C^R$rgb are subtracted in the calculation of the complementary top correction term $C'^R$cmy in accordance with expression (10a). It should be noted that Hcmy/($RGB_{MAX}$+1) is equal to or more than 0 and less than 1, since the complementary color distance Hcmy ranges from 0 to $RGB_{MAX}$. It would be understood by a person skilled in the art from the above-described discussion that expression (10a) is determined to calculate the complementary top correction term $C'^R$cmy by partially cancelling the effect of the correction with respect to the white point and intermediate grayscale values.

The similar applies to the other complementary top correction terms $C'^G$cmy and $C'^B$cmy. In expressions (10b) and (10c), the terms "−Hcmy·$S^G$/($RGB_{MAX}$+1)" and "−Hcmy·$S^B$/($RGB_{MAX}$+1)" are introduced to partially cancel the effect of the correction with respect to the white color and intermediate grayscale values. Operations of subtracting the Hcmy/($RGB_{MAX}$+1) times of $S^G$ and $S^B$ are performed in expression (10b) and (10c), respectively, to partially cancel the effect of the correction with respect to the white point and intermediate grayscale values.

The similar applies to the elementary color top correction terms {$C'^R$rgb, $C'^G$rgb, $C'^B$rgb}. In expressions (11a) to (11c), the terms "−Hrgb·$S^R$/($RGB_{MAX}$+1)", "−Hrgb·$S^G$/($RGB_{MAX}$+1)" and "−Hrgb·$S^B$/($RGB_{MAX}$+1)" are introduced to partially cancel the effect of the correction with respect to the white point and intermediate grayscale values. Operations to subtract the Hrgb/($RGB_{MAX}$+1) times of the sums $S^R$, $S^G$ and $S^B$ are performed in expressions (11a) to (11c), respectively, to thereby partially cancel the effect of the correction with respect to the white point and intermediate grayscale values.

It should be note that various different approaches may be used to partially cancel the effect of the correction with respect to the white point and intermediate grayscale values. In general, the calculations of the complementary color top correction terms $C'^R$cmy, $C'^G$cmy and $C'^B$cmy may respectively include operations of subtracting the $\beta_1$ times of the sums $S^R$, $S^G$ and $S^B$, respectively, from values obtained from the complementary color distance Hcmy, the C complementary color correction parameters T'c, the M complementary color correction parameters T'm, and the Y complementary color correction parameters T'm, where $\beta_1$ is a value depending on the complementary color distance Hcmy, satisfying $0 \leq \beta_1 < 1$. Although $\beta_1$ is determined as Hcmy/($RGB_{MAX}$+1) in the above-described embodiments, $\beta_1$ may be calculated through a different calculation.

Similarly, the calculations of the elementary color top correction terms $C'^R$rgb, $C'^G$rgb, and $C'^B$rgb may respectively include operations of subtracting the $\beta_2$ times of the sums $S^R$, $S^G$, and $S^B$, respectively, from values obtained from the elementary color distance Hrgb, the R elementary color point correction parameters T'r, the G elementary color point correction parameters T'g, and the B elementary color point correction parameters T'b, where $\beta_2$ is a value depending on the elementary color distance Hrgb, satisfying $0 \leq \beta_2 < 1$. In the above-described embodiment, $\beta_2$ is determined as Hrgb/($RGB_{MAX}$+1). It should be noted that Hrgb/($RGB_{MAX}$+1) is equal to or more than 0 and less than 1, since the elementary color distance Hrgb ranges from 0 to $RGB_{MAX}$. $\beta_2$ may be calculated through a different calculation.

It should be also noted that $RGB_{MAX}$+1 is a number representable as $2^n$ for n being an integer of two or more, because $RGB_{MAX}$ is a number representable as $2^n-1$. This implies that the values $S^R$/($RGB_{MAX}$+1), $S^G$/($RGB_{MAX}$+1) and $S^B$/($RGB_{MAX}$+1) can be easily obtained by performing a right shift or bit truncation on the sums $S^R$, $S^G$, and $S^B$, respectively. This fact helps reducing the hardware resource used to calculate the elementary color top correction terms {$C'^R$rgb, $C'^G$rgb, $C'^B$rgb}.

The adder 31 calculates the correction factors {$Q^R$, $Q^G$, $Q^B$} on the basis of the above-described sums {$S^R$, $S^G$, $S^B$}, the complementary color top correction terms {$C'^R$cmy, $C'^G$cmy, $C'^B$cmy} and the elementary color top correction terms {$C'^R$rgb, $C'^G$rgb, $C'^B$rgb}. In the present embodiment, the correction factors {$Q^R$, $Q^G$, $Q^B$} are calculated in accordance with the following expressions (12a) to (12c):

$$Q^R = S^R + C^R cmy + C'^R rgb, \tag{12a}$$

$$Q^G = S^G + C^G cmy + C'^G rgb, \text{ and} \tag{12b}$$

$$Q^B = S^B + C^B cmy + C'^B rgb. \tag{12c}$$

It should be noted that, since the sum $S^R$ is calculated from the white color correction term $C^R$w, the complementary color intermediate correction term $C^R$cmy and the elementary color intermediate correction term $C^R$rgb as is understood from expression (9a), the correction factor $Q^R$ is calculated on the basis of five terms: the white color correction term $C^R$w, the complementary color intermediate correction term $C^R$cmy, the elementary color intermediate correction term $C^R$rgb, the complementary color top correction term $C'^R$cmy, and the elementary color top correction term $C'^R$rgb. Similarly, since the sum $S^G$ is calculated from the white color correction term $C^G$w, the complementary color intermediate correction term $C^G$cmy and the elementary color intermediate correction term $C^G$rgb as is understood from expression (9b), the correction factor $Q^G$ is calculated on the basis of five terms: the white color correction term $C^a$w, the complementary color intermediate correction term $C^G$cmy, the elementary color intermediate correction term $C^G$rgb, the complementary color top correction term $C'^G$cmy, and the elementary color top correction term $C'^G$rgb. Finally, since the sum $S^B$ is calculated from the white color correction term $C^B$w, the complementary color intermediate correction term $C^B$cmy, and the elementary color intermediate correction term $C^B$rgb as is understood from expression (9c), the correction factor $Q^B$ is calculated on the basis of five terms: the white color correction term $C^B$w, the complementary color intermediate correction term $C^B$cmy, the elementary color intermediate correction term $C^B$rgb, the complementary color top correction term $C'^B$cmy, and the elementary color top correction term $C'^B$rgb.

In detail, expressions (12a) to (12c) can be rewritten as expressions (13a) to (13c) on the basis of expressions (9a) to (9c):

$$Q^R = C^R w + C^R cmy + C^R rgb + C'^R cmy + C'^R rgb, \tag{13a}$$

$$Q^G = C^G w + C^G cmy + C^G rgb + C'^G cmy + C'^G rgb, \tag{13b}$$

and $$Q^B = C^B w + C^B cmy + C^B rgb + C'^B cmy + C'^B rgb. \tag{13c}$$

In the present embodiment, as is understood from expression (13a), the correction factor $Q^R$ associated with the elementary color R is calculated as the sum of the white color correction term $C^R$w, the complementary color intermediate correction term $C^R$cmy, the elementary color intermediate correction term $C^R$rgb, the complementary color top correction term $C'^R$cmy, and the elementary color top correction term $C'^R$rgb, which are all associated with the elementary color R. Similarly, as is understood from expression (13b), the correction factor $Q^G$ associated with the elementary color G is calculated as the sum of the white color correction term $C^a$w, the complementary color intermediate correction term $C^G$cmy, the elementary color intermediate correction term $C^G$rgb, the complementary color top correction term $C'^G$cmy, and the elementary color top correction term $C'^G$rgb, which are all associated with the elementary color G. Furthermore, as is understood from expression (13c), the correction factor $Q^B$ associated with the elementary color B is calculated as the sum of the white color correction term $C^B$w, the complementary color intermediate correction term $C^B$cmy, the elementary color intermediate correction term $C^B$rgb, the complementary color top correction term $C'^B$cmy, and the elementary color top correction term $C'^B$rgb, which are all associated with the elementary color B.

The correction factors $\{Q^R, Q^G, Q^B\}$ calculated by the adder 31 are supplied to the correction processing circuit 11 and used for the correction performed by the correction processing circuit 11, that is, the digital processing for color adjustment. In the present embodiment, the correction processing circuit 11 calculates the RGB grayscale values {Rout, Gout, Bout} of the output image data by correcting the RGB grayscale values {Rin, Gin, Bin} of the input image data in accordance with the following expressions (14a) to (14c):

$$Rout=Rin+Q^R/(RGB_{MAX}+1), \tag{14a}$$

$$Gout=Gin+Q^G/(RGB_{MAX}+1), \text{ and} \tag{14b}$$

$$Bout=Bin+Q^B/(RGB_{MAX}+1). \tag{14c}$$

The color adjustment circuit 10 of the present embodiment can control the chromaticity coordinates of the R elementary color point, G elementary color point, B elementary color point, C complementary color point, M complementary color point, and Y complementary color point in images displayed in response to the output image data by properly setting the top correction parameters, which specify the RGB grayscale values {Rout, Gout, Bout} of the output image data for the case when input image data corresponding to the R elementary color point, G elementary color point, B elementary color point, C complementary color point, M complementary color point, and Y complementary color point are respectively supplied to the correction processing circuit 11. This means that the color adjustment circuit 10 of the present embodiment effectively achieves the adjustment of the color gamut.

Additionally, the color adjustment circuit 10 can control the chromaticity coordinates of the white point in images displayed in response to the output image data by properly setting the white point correction parameters Tw which specify the RGB grayscale values {Rout, Gout, Bout} of the output image data for the case when an input image data corresponding to the white point is supplied to the correction processing circuit 11. This means that the color adjustment circuit 10 of the present embodiment effectively achieves the adjustment of the chromaticity coordinates of the white point.

Additionally, the color adjustment circuit 10 of the present embodiment can control the input-output property of the correction processing circuit 11 for intermediate grayscale values with the intermediate correction parameters. This allows achieving color adjustment on the basis of the gamma property of the display apparatus.

It should be also noted that, as is understood from expressions (14a) to (14c), the output image data of the RGB format are obtained without converting the input image data of the RGB format into that of the format of a different color system. The R grayscale value Rout of an output image data is calculated from the R grayscale value Rin of an input image data and the correction factor $Q^R$ associated with the elementary color R. Similarly, the G grayscale value Gout of an output image data is calculated from the G grayscale value Gin of an input image data and the correction factor $Q^G$ associated with the elementary color G, and the B grayscale value Bout of an output image data is calculated from the B grayscale value Bin of an input image data and the correction factor $Q^B$ associated with the elementary color B. The color adjustment through such operation eliminates the need for performing a matrix operation, effectively reducing the circuit size.

Figure 8:
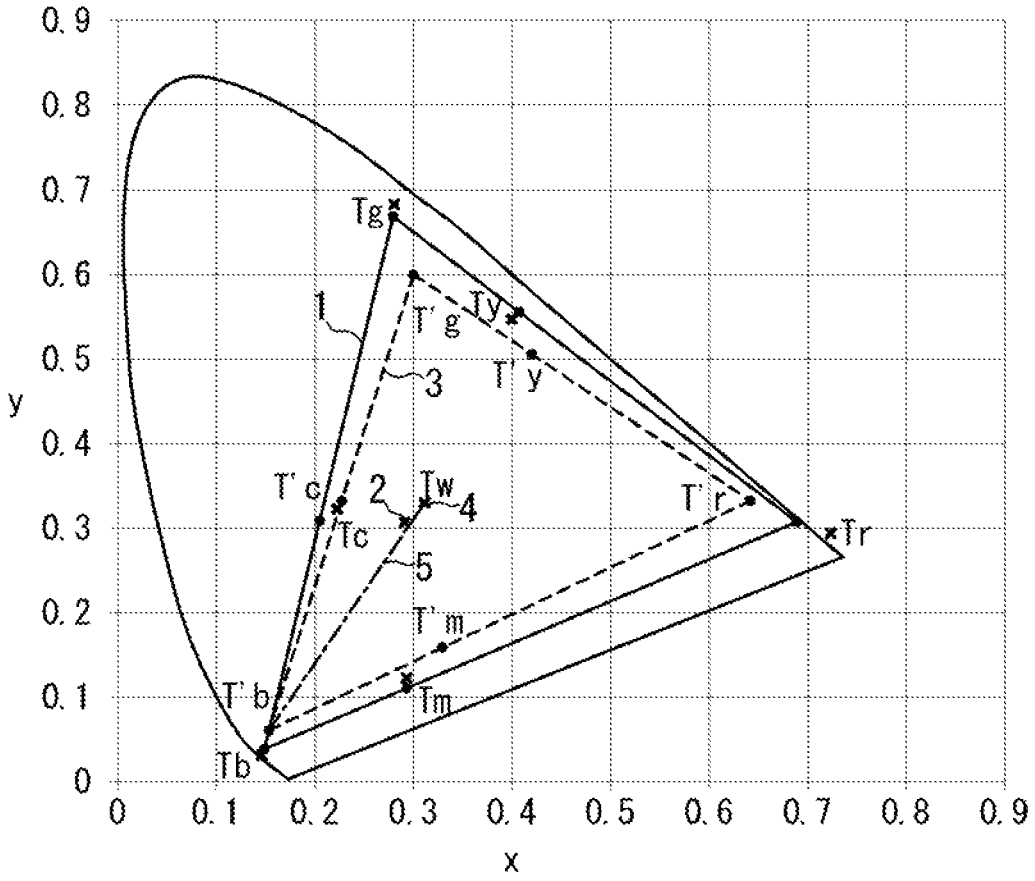
FIG. 8 is a chromaticity diagram illustrating one example of color adjustment achieved by the color adjustment circuit of the present embodiment.

FIG. 8 is a chromaticity diagram illustrating one example of the color adjustment by the color adjustment circuit 10 of the present embodiment. In this example, the color gamut and the white point are adjusted as specified in the sRGB specification. In the example of FIG. 8, the white point correction parameters Tw, R elementary color point correction parameters T'r, G elementary color point correction parameters T'g, B elementary color point correction parameters T'b, C complementary color point correction parameters T'c, M complementary color point correction parameters T'm, and Y complementary color point correction parameters T'y are set as follows:

$$\{Tw^R, Tw^G, Tw^B\}=\{255,236,219\},$$

$$\{T'r^R, T'r^G, T'r^B\}=\{255,62,31\},$$

$$\{T'g^R T'g^G, T'g^B\}=\{116,255,70\},$$

$$\{T'b^R T'b^G, T'b^B\}=\{0,63,255\},$$

$$\{T'c^R T'c^G, T'c^B\}=\{109,255,243\},$$

$$\{T'm^R, T'm^G, T'm^B\}=\{255,81,244\}, \text{ and}$$

$$\{T'y^R, T'y^G, T'y^B\}=\{255,227,66\}.$$

It should be noted that the white point correction parameters Tw, R elementary color point correction parameters T'r, G elementary color point correction parameters T'g, B elementary color point correction parameters T'b, C complementary color point correction parameters T'c, M complementary color point correction parameters T'm, and Y complementary color point correction parameters T'y can be calculated from the chromaticity coordinates and relative luminances of the white point and the R, G, and B elementary color points specified in the sRGB specification, and the XYZ-RGB conversion matrix of the targeted display apparatus. The XYZ-RGB conversion matrix of the targeted display apparatus can be calculated from the luminances Y (stimulus values Y) and chromaticity coordinates x and y measured for the white point, R elementary color point, G elementary color point and B elementary color point in images displayed on the display apparatus.

In the example illustrated in FIG. 8, the R intermediate correction parameters Tr, G intermediate correction parameters Tg, B intermediate correction parameters Tb, C intermediate correction parameters Tc, M intermediate correction parameters Tm and Y intermediate correction parameters Ty are set as follows:

$\{Tr^R, Tr^G, Tr^B\}=\{255,-53,-30\}$, $\{Tg^R, Tg^G, Tg^B\}=\{-27,255,-34\}$, $\{Tb^R, Tb^G, Tb^B\}=\{11,-37,255\}$, $\{Tc^R, Tc^G, Tc^B\}=\{92,254,245\}$, $\{Tm^R, Tm^G, Tm^B\}=\{239,61,239\}$, and $\{Ty^R, Ty^G, Ty^B\}=\{255,255,54\}$.

Figure 9:
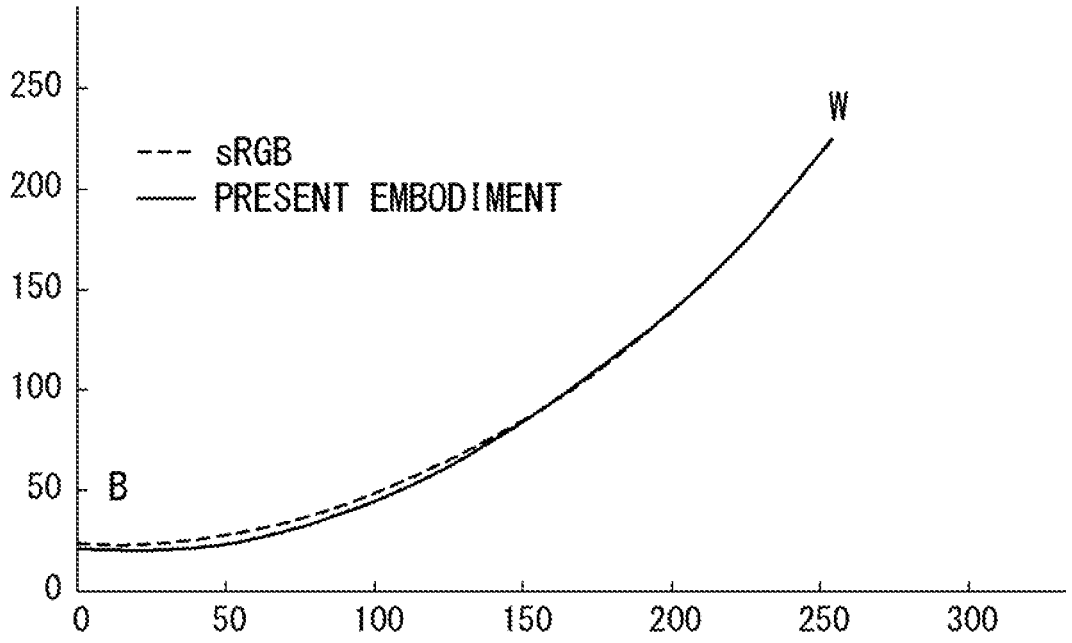
FIG. 9 is a graph illustrating the variation in the brightness level when the color is changed along the segment connecting the B elementary color point and the white point in the chromaticity diagram, for the case when the color gamut and the white point are adjusted in the present embodiment.

FIG. 9 is a graph illustrating the variation in the brightness level when the color is changed along the segment connecting the B elementary color point and the white point in the chromaticity diagram, for the case when the color gamut and the white point are adjusted in accordance with the above-described settings. Note that the broken line in FIG. 9 indicates the variation in the brightness level when the color is changed along the segment connecting the B elementary color point and the white point in the chromaticity diagram, in accordance with the sRGB specification. As is understood from FIG. 9, the adjustment of the color gamut and the white point in the present embodiment offers the variation in the brightness level approximate to that in the sRGB specification. This implies that the scheme presented in the present embodiment effectively achieves adjustment of the color gamut and the white point with a brightness balance approximate to that in accordance with the sRGB specification, that is, with a gamma property approximate to that specified in the sRGB specification.

It should be noted that the circuits included in the color adjustment circuit 10 of the present disclosure only performs digital processing implementable with a reduced circuit size, such as addition, multiplication, data comparison and right shift (bit truncation). The color adjustment circuit 10 of the present embodiment is designed to exclude large-sized circuits, such as an LUT (lookup table) and a circuit which performs a power operation. This means that the color adjustment circuit 10 of the present embodiment effectively achieves color adjustment on the basis of the gamma property of the display apparatus with a reduced circuit size.

The color adjustment circuit 10 of the present embodiment, which effectively offers circuit size reduction, is suitable for applications for which circuit size reduction is strongly requested. One such application is a color adjustment circuit integrated in a display driver which drives a display panel (e.g., a liquid crystal display panel and an OLED (organic light emitting diode) display panel) in a display apparatus. Use of the color adjustment circuit 10 of the present embodiment is especially effective for a display apparatus mounted on a mobile terminal, for which circuit size reduction is strongly requested. In the following, a description is given of one example of the configuration of a display apparatus incorporating the color adjustment circuit 10 of the present embodiment.

Figure 10:
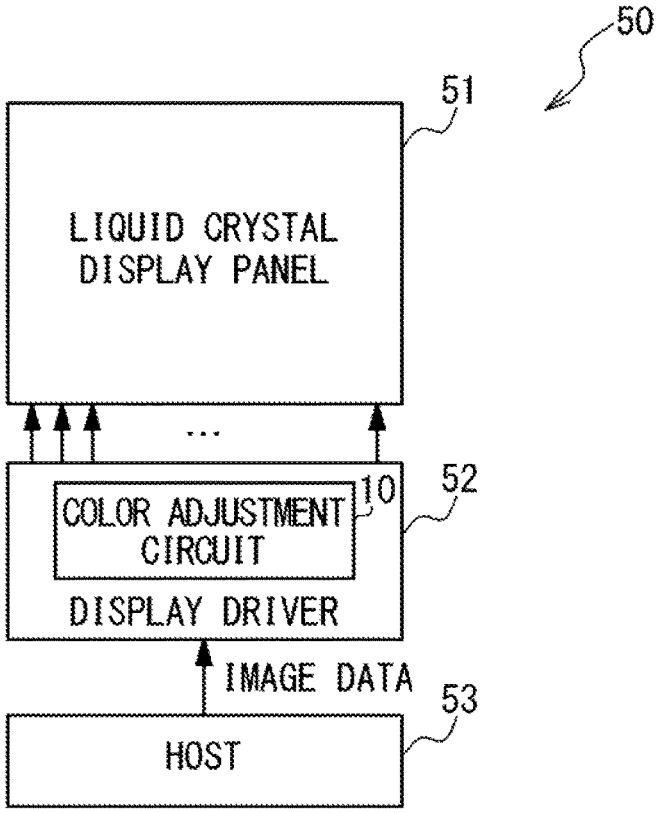
FIG. 10 is a block diagram illustrating an exemplary configuration of a display apparatus in one embodiment.

FIG. 10 is a block diagram illustrating the configuration of a display apparatus 50 in one embodiment. In the present embodiment, the display apparatus 50 is configured as a liquid crystal display apparatus including a liquid crystal display panel 51 and a display driver 52. It should be noted that, although a description is given below of embodiments in which the display apparatus 50 is configured as a liquid crystal display apparatus, the present disclosure is applicable to display apparatuses including a display device other than the liquid crystal display panel 51 (e.g., an OLED (organic light emitting diode) display panel).

The liquid crystal display panel 51 includes pixels arrayed in rows and columns, gate lines and source lines (these elements are not illustrated). In the present embodiment, each pixel includes an R subpixel displaying the red color, a G subpixel displaying the green color, and a B subpixel displaying the blue color. Each subpixel (the R, G, or B subpixel) is connected to the corresponding gate line and source line.

The display driver 52 drives the source lines of the liquid crystal display panel 1 in response to image data received from a host 53. The display driver 52 includes the above-described color adjustment circuit 10 and the display driver 52 is configured to drive the source lines of the liquid crystal display panel 1 in response to the output image data output from the color adjustment circuit 10.

Figure 11:
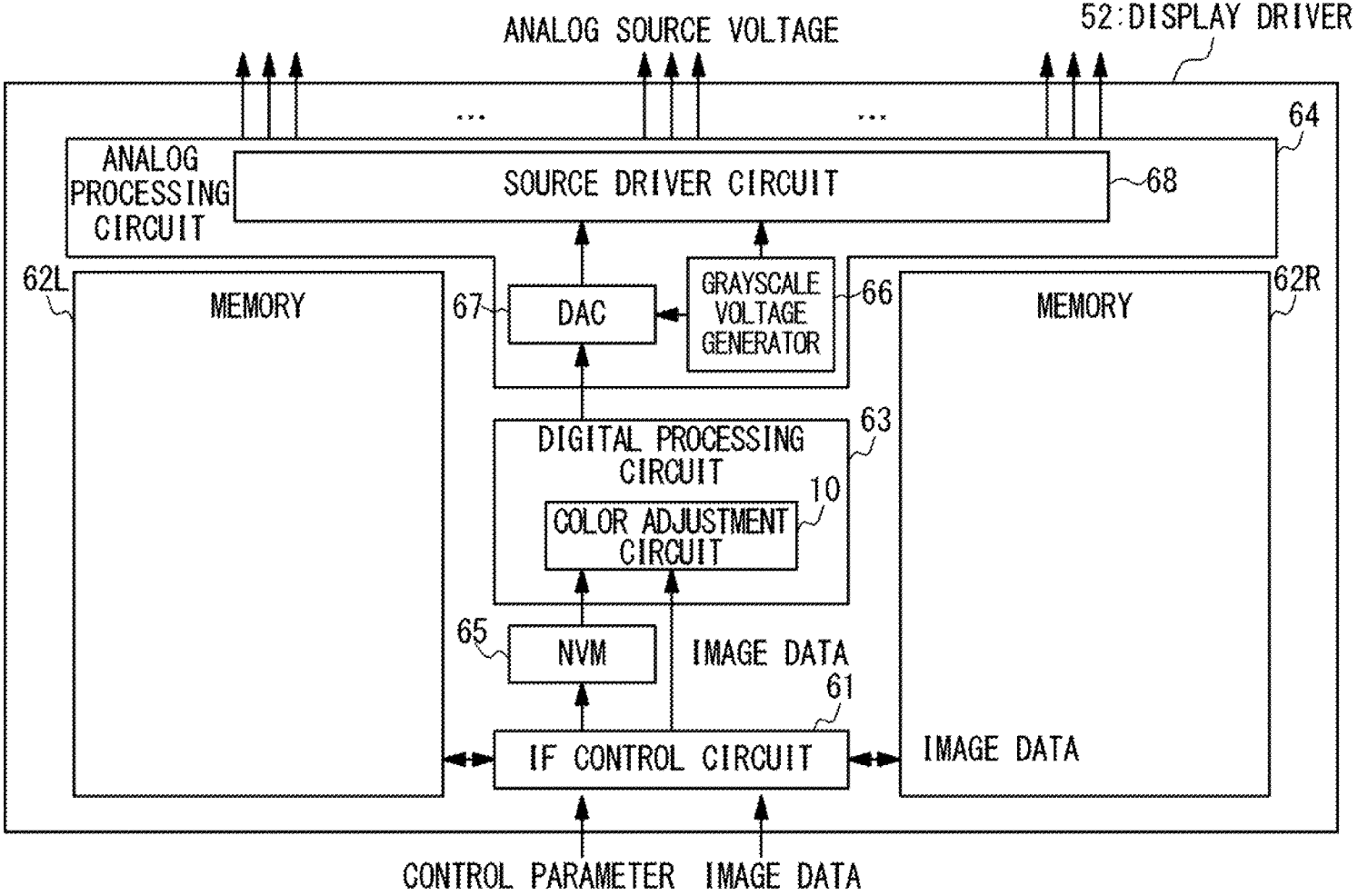
FIG. 11 is a block diagram illustrating an exemplary configuration of a display driver in one embodiment.

FIG. 11 is a block diagram illustrating an exemplary configuration of the display driver 52 in one embodiment. In the present embodiment, the display driver 52 includes an interface control circuit 61, memories 62R and 62L, a digital processing circuit 63, an analog processing circuit 64, a non-volatile memory (NVM) 65.

The interface control circuit 61 receives externally-supplied data (from the host 53, for example). In detail, the interface control circuit 61 receives image data from the host 53, writes the received image data into the memories 62L and 62R and transfers the image data stored in the memories 62L and 62R to the digital processing circuit 63. Additionally, the interface control circuit 61 externally receives control parameters to control the display driver 52 and writes the control parameters into the non-volatile memory 65.

The memories 62L and 62R temporarily stores the image data received from the interface control circuit 61.

The digital processing circuit 63 performs desired digital processing on the image data received from the memories 62L and 62R via the interface control circuit 61 to generate digitally-processed image data. The digital processing circuit 63 includes the above-described color adjustment circuit 10. The color adjustment circuit 10 performs the above-described digital processing for color adjustment, using as the input image data the image data received from the memories 62L and 62R or data obtained by performing desired digital processing on the received image data, to generate the output image data. The output image data output from the color adjustment circuit 10 or data obtained by performing desired digital processing on the output image data are output from the digital processing circuit 63 as the digitally-processed image data.

The analog processing circuit 64 operates as a drive circuitry which drives the source lines of the liquid crystal display panel 51 in response to the digitally-processed image data received from the digital processing circuit 63 (that is, in response to the output image data output from the color adjustment circuit 10). More specifically, the analog processing circuit 64 includes a grayscale voltage generator circuit 66, a DA converter (DAC) 67 and a source driver circuit 68.

The grayscale voltage generator circuit 66 generates a set of grayscale voltages having voltage levels which match the targeted gamma property of the display apparatus 50 and supplies the set of grayscale voltages to the DA converter 67. The gamma property of the display apparatus 50 can be adjusted by controlling the voltage levels of the grayscale voltages generated by the grayscale voltage generator circuit 66.

The DA converter 67 selects grayscale voltages corresponding to the digitally-processed image data for the respective source lines of the liquid crystal display panel 51 and outputs the selected grayscale voltages.

The source driver circuit 68 outputs analog source voltages having voltage levels corresponding to the grayscale voltages received from the DA converter 67 (most typically, the voltage levels equal to those of the grayscale voltages) to the respective source lines of the liquid crystal display panel 51 to thereby drive the source lines.

The non-volatile memory 65 stores various control parameters used for controlling the operation of the display driver 52 in a non-volatile manner. In the present embodiment, the control parameters stored in the non-volatile memory 65 include the parameters to be set to the register circuit 13 of the color adjustment circuit 10 (that is, the color definition data, the white point correction parameters, the intermediate correction parameters, and the top correction parameters). When the display driver 52 is operated to display an image on the liquid crystal display panel 51, the above-described parameters to be set to the register circuit 13 are read out from the non-volatile memory 65 and supplied to the color adjustment circuit 10. This allows the color adjustment circuit 10 to perform digital processing in response to the parameters.

The display driver 52 is configured so that the color definition data, the white point correction parameters, the intermediate correction parameters, and the top correction parameters stored in the non-volatile memory 65 are rewritable from outside the display driver 52. For example, the white point correction parameters, the intermediate correction parameters, and the top correction parameters are externally supplied (from the host 53, for example) to the display driver 52 and written into the non-volatile memory 65 via the interface control circuit 61. This configuration allows variously controlling the color adjustment performed by the color adjustment circuit 10 from outside the display driver 52, effectively improving the flexibility of the color adjustment.

Although various embodiments of the present disclosure have been specifically described, the present disclosure must not be construed as being limited to the above-described embodiment. It would be apparent to a person skilled in the art that the present disclosure may be implemented with various modifications.

What is claimed is:

1. A color adjustment circuit, comprising:

a correction factor calculation circuit comprising:

a white color distance calculation circuit configured to calculate a white color distance between a white point in a color space and an input-corresponding point of input image data;

a complementary color distance calculation circuit configured to calculate a complementary color distance between the input-corresponding point and a closest complementary color point in the color space;

an elementary color distance calculation circuit configured to calculate an elementary color distance between the input-corresponding point and a closest elementary color point in the color space; and factor calculation circuitry configured to calculate correction factors based on the white color distance, the complementary color distance, the elementary color distance, white point correction parameters specifying one or more grayscale values corresponding to the white point for one or more elementary colors, top correction parameters corresponding to at least one elementary color point and at least one complementary color point in the color space, and intermediate correction parameters corresponding to at least one elementary color and to at least one complementary color for an intermediate grayscale value; and a correction processing circuit configured to generate output image data by applying the correction factors to the input image data.

2. The color adjustment circuit according to claim 1, wherein the factor calculation circuitry includes:

a white color correction term calculation circuit configured to calculate white color correction terms based on the white point correction parameters and the white color distance;

a complementary color intermediate correction term calculation circuit configured to calculate complementary color intermediate correction terms based on the complementary color distance and at least one of the intermediate correction parameters corresponding to the at least one complementary color;

an elementary color intermediate correction term calculation circuit configured to calculate elementary color intermediate correction terms based on the elementary color distance and at least one of the intermediate correction parameters corresponding to the at least one elementary color;

a complementary color top correction term calculation circuit configured to calculate complementary color top correction terms based on the complementary color distance and at least one of the top correction parameters corresponding to the at least one complementary color; and an elementary color top correction term calculation circuit configured to calculate elementary color top correction terms based on the elementary color distance and at least one of the top correction parameters corresponding to the at least one elementary color, wherein the correction factors are calculated based on the white color correction terms, the complementary color intermediate correction terms, the elementary color intermediate correction terms, the complementary color top correction terms, and the elementary color top correction terms.

3. The color adjustment circuit according to claim 2, wherein the complementary color top correction terms are each calculated as a value obtained by subtracting $\beta_1$ times of a sum of a corresponding one of the white color correction terms and a corresponding one of the complementary color intermediate correction terms from a value obtained from the complementary color distance and a corresponding one of the top correction parameters corresponding to a complementary color C, M, or Y, $\beta_1$ depending on the complementary color distance and satisfying $0 \leq \beta_1 < 1$, and wherein the elementary color top correction terms are each calculated as a value obtained by subtracting $\beta_2$ times of a sum of a corresponding one of the white color correction terms and a corresponding one of the elementary color intermediate correction terms from a value obtained from the elementary color distance and a corresponding one of the top correction parameters corresponding to an elementary color R, G, or B, $\beta_2$ depending on the elementary color distance and satisfying $0 \leq \beta_2 < 1$.

4. The color adjustment circuit of claim 2, wherein the at least one complementary color comprises complementary colors C, M, and Y, and wherein the at least one elementary color comprises elementary colors R, G, and B.

5. The color adjustment circuit according to claim 1, wherein the input image data and the output image data are both in an RGB format, wherein the correction factors include a first correction factor associated with an elementary color R, a second correction factor associated with an elementary color G, and a third correction factor associated with an elementary color B, wherein an R grayscale value of the output image data is calculated from an R grayscale value of the input image data and the first correction factor, wherein a G grayscale value of the output image data is calculated from a G grayscale value of the input image data and the second correction factor, and wherein a B grayscale value of the output image data is calculated from a B grayscale value of the input image data and the third correction factor.

6. The color adjustment circuit according to claim 1, further comprising:

a white point correction parameter register configured to store therein the white point correction parameters;

an intermediate correction parameter register configured to store therein the intermediate correction parameters; and a top correction parameter register configured to store therein the top correction parameters.

7. The color adjustment circuit of claim 1, wherein the closest complementary color point in the color space is one of C, M, and Y complementary color points closest to the input-corresponding point in the color space, wherein the closest elementary color point in the color space is of R, G, and B elementary color points closest to the input-corresponding point in the color space, wherein the white point correction parameters specify R, G, and B grayscale values of the output image data when the input image data corresponds to the white point, wherein the top correction parameters specify R, G, and B grayscale values of the output image data when the input image data corresponds to each of the R, G, and B elementary color points and to each of the C, M, and Y complementary color points and wherein the intermediate correction parameters specify R, G, and B grayscale values of the output image data when the input image data corresponds to each of elementary colors R, G, and B and each of complementary colors C, M, and Y of the intermediate grayscale value.

8. A display driver for driving a display panel, the display driver comprising:

a correction factor calculation circuit comprising:

a white color distance calculation circuit configured to calculate a white color distance between a white point in a color space and an input-corresponding point of input image data;

a complementary color distance calculation circuit configured to calculate a complementary color distance between the input-corresponding point and a closest complementary color point in the color space;

an elementary color distance calculation circuit configured to calculate an elementary color distance between the input-corresponding point and a closest elementary color point in the color space; and factor calculation circuitry configured to calculate correction factors based on the white color distance, the complementary color distance, the elementary color distance, white point correction parameters specifying one or more grayscale values corresponding to the white point for one or more elementary colors, top correction parameters corresponding to at least one elementary color point and at least one complementary color point in the color space, and intermediate correction parameters corresponding to at least one elementary color and to at least one complementary color for an intermediate grayscale value;

a correction processing circuit configured to generate output image data by applying the correction factors to the input image data; and drive circuitry configured to drive the display panel in response to the output image data.

9. The display driver according to claim 8, wherein the factor calculation circuitry includes:

a white color correction term calculation circuit configured to calculate white color correction terms based on the white point correction parameters and the white color distance;

a complementary color intermediate correction term calculation circuit configured to calculate complementary color intermediate correction terms based on the complementary color distance and at least one of the intermediate correction parameters corresponding to the at least one complementary color;

an elementary color intermediate correction term calculation circuit configured to calculate elementary color intermediate correction terms based on the elementary color distance and at least one of the intermediate correction parameters corresponding to the at least one elementary color;

a complementary color top correction term calculation circuit configured to calculate complementary color top correction terms based on the complementary color distance and at least one of the top correction parameters corresponding to the at least one complementary color; and an elementary color top correction term calculation circuit configured to calculate elementary color top correction terms based on the elementary color distance and at least one of the top correction parameters corresponding to the at least one elementary color, wherein the correction factors are calculated based on the white color correction terms, the complementary color intermediate correction terms, the elementary color intermediate correction terms, the complementary color top correction terms, and the elementary color top correction terms.

10. The display driver according to claim 9, wherein the complementary color top correction terms are each calculated as a value obtained by subtracting $\beta_1$ times of a sum of a corresponding one of the white color correction terms and a corresponding one of the complementary color intermediate correction terms from a value obtained from the complementary color distance and a corresponding one of the top correction parameters corresponding to a complementary color C, M, or Y, $\beta_1$ depending on the complementary color distance and satisfying $0 \leq \beta_1 < 1$, and wherein the elementary color top correction terms are each calculated as a value obtained by subtracting $\beta_2$ times of a sum of a corresponding one of the white color correction terms and a corresponding one of the elementary color intermediate correction terms from a value obtained from the elementary color distance and a corresponding one of the top correction parameters corresponding to an elementary color R, G, or B, $\beta_2$ depending on the elementary color distance and satisfying $0 \leq \beta_2 < 1$.

11. The display driver of claim 9, wherein the at least one complementary color comprises complementary colors C, M, and Y, and wherein the at least one elementary color comprises elementary colors R, G, and B.

12. The display driver according to claim 8, wherein the input image data and the output image data are both in an RGB format, wherein the correction factors include a first correction factor associated with an elementary color R, a second correction factor associated with an elementary color G, and a third correction factor associated with an elementary color B, wherein an R grayscale value of the output image data is calculated from an R grayscale value of the input image data and the first correction factor, wherein a G grayscale value of the output image data is calculated from a G grayscale value of the input image data and the second correction factor, and wherein a B grayscale value of the output image data is calculated from a B grayscale value of the input image data and the third correction factor.

13. The display driver according to claim 8, further comprising:

a non-volatile memory configured to store therein the white point correction parameters, the intermediate correction parameters, and the top correction parameters, and wherein the white point correction parameters, the intermediate correction parameters, and the top correction parameters stored in the non-volatile memory are externally rewritable.

14. The display driver of claim 8, wherein the closest complementary color point in the color space is one of C, M, and Y complementary color points closest to the input-corresponding point in the color space, wherein the closest elementary color point in the color space is of R, G, and B elementary color points closest to the input-corresponding point in the color space, wherein the white point correction parameters specify R, G, and B grayscale values of the output image data when the input image data corresponds to the white point, wherein the top correction parameters specify R, G, and B grayscale values of the output image data when the input image data corresponds to each of the R, G, and B elementary color points and to each of the C, M, and Y complementary color points and wherein the intermediate correction parameters specify R, G, and B grayscale values of the output image data when the input image data corresponds to each of elementary colors R, G, and B and each of complementary colors C, M, and Y of the intermediate grayscale value.

15. The display driver of claim 8, wherein the correction processing circuit is further configured to receive the input image data comprising image data received from a host.

16. The display driver of claim 8, wherein the correction processing circuit is further configured to receive the input image data comprising data obtained by performing digital processing on image data.

17. A display apparatus, comprising:

a display panel; and a display driver configured to drive the display panel, the display driver comprising:

a correction factor calculation circuit comprising:

a white color distance calculation circuit configured to calculate a white color distance between a white point in a color space and an input-corresponding point of input image data;

a complementary color distance calculation circuit configured to calculate a complementary color distance between the input-corresponding point and a closest complementary color point in the color space;

an elementary color distance calculation circuit configured to calculate an elementary color distance between the input-corresponding point and a closest elementary color point in the color space; and factor calculation circuitry configured to calculate correction factors based on the white color distance, the complementary color distance, the elementary color distance, white point correction parameters specifying one or more grayscale value corresponding to the white point for one or more elementary colors, top correction parameters corresponding to at least one elementary color point and at least one complementary color point in the color space, and intermediate correction parameters corresponding to at least one elementary color and to at least one complementary color for an intermediate grayscale value; and a correction processing circuit configured to generate output image data by applying the correction factors to the input image data; and drive circuitry configured to drive the display panel in response to the output image data.

18. The display apparatus of claim 17, wherein the closest complementary color point in the color space is one of C, M, and Y complementary color points closest to the input-corresponding point in the color space, wherein the closest elementary color point in the color space is of R, G, and B elementary color points closest to the input-corresponding point in the color space, wherein the white point correction parameters specify R, G, and B grayscale values of the output image data when the input image data corresponds to the white point, wherein the top correction parameters specify R, G, and B grayscale values of the output image data when the input image data corresponds to each of the R, G, and B elementary color points and to each of the C, M, and Y complementary color points and wherein the intermediate correction parameters specify R, G, and B grayscale values of the output image data when the input image data corresponds to each of elementary colors R, G, and B and each of complementary colors C, M, and Y of the intermediate grayscale value.

19. The display apparatus of claim 17, wherein the factor calculation circuitry includes:

a white color correction term calculation circuit configured to calculate white color correction terms based on the white point correction parameters and the white color distance;

a complementary color intermediate correction term calculation circuit configured to calculate complementary color intermediate correction terms based on the complementary color distance and at least one of the intermediate correction parameters corresponding to the at least one complementary color;

an elementary color intermediate correction term calculation circuit configured to calculate elementary color intermediate correction terms based on the elementary color distance and at least one of the intermediate correction parameters corresponding to the at least one elementary color;

a complementary color top correction term calculation circuit configured to calculate complementary color top correction terms based on the complementary color distance and at least one of the top correction parameters corresponding to the at least one complementary color; and an elementary color top correction term calculation circuit configured to calculate elementary color top correction terms based on the elementary color distance and at least one of the top correction parameters corresponding to the at least one elementary color, wherein the correction factors are calculated based on the white color correction terms, the complementary color intermediate correction terms, the elementary color intermediate correction terms, the complementary color top correction terms, and the elementary color top correction terms.

20. The display apparatus of claim 19, wherein the complementary color top correction terms are each calculated as a value obtained by subtracting $\beta_1$ times of a sum of a corresponding one of the white color correction terms and a corresponding one of the complementary color intermediate correction terms from a value obtained from the complementary color distance and a corresponding one of the top correction parameters corresponding to a complementary color C, M, or Y, $\beta_1$ depending on the complementary color distance and satisfying $0 \leq \beta_1 < 1$, and wherein the elementary color top correction terms are each calculated as a value obtained by subtracting $\beta_2$ times of a sum of a corresponding one of the white color correction terms and a corresponding one of the elementary color intermediate correction terms from a value obtained from the elementary color distance and a corresponding one of the top correction parameters corresponding to an elementary color R, G, or B, $\beta_2$ depending on the elementary color distance and satisfying $0 \leq \beta_2 < 1$.

* * * * *